US005398647A

United States Patent [19]

Rivera

[11] Patent Number: 5,398,647

[45] Date of Patent: Mar. 21, 1995

[54] COMBINED SLEEVE/POPPET VALVE FOR INTERNAL COMBUSTION ENGINE

[76] Inventor: Efrain Rivera, 1735 Purdy St., Apt. 6E, Bronx, N.Y. 10462

[21] Appl. No.: 197,128

[22] Filed: Feb. 16, 1994

[51] Int. Cl.[6] ..... F01L 7/00

[52] U.S. Cl. ..... 123/79 R; 123/190.8

[58] Field of Search ..... 123/79 R, 794, 59.3, 123/190.12, 190.8

[56] References Cited

U.S. PATENT DOCUMENTS

| | | | |
|---|---|---|---|
| 1,335,515 | 3/1920 | Lombard | 123/79 A |
| 2,107,389 | 2/1938 | Price et al. | 123/190.8 |
| 3,871,340 | 3/1975 | Zimmerman | 173/190.8 |
| 3,948,227 | 4/1976 | Guenther | 123/190.8 |
| 5,081,966 | 1/1992 | Hansen | 123/190 B |
| 5,154,395 | 10/1992 | Horvei | 251/161 |
| 5,183,014 | 2/1993 | Stevenson | 123/59 AC |
| 5,191,863 | 3/1993 | Hagiwara | 123/59 AC |
| 5,205,251 | 4/1993 | Conklin | 123/190.12 |
| 5,315,969 | 5/1994 | MacMillan | 123/190.8 |

FOREIGN PATENT DOCUMENTS

| | | | |
|---|---|---|---|
| 2393934 | 2/1979 | France | 123/79 A |

*Primary Examiner*—David A. Okonsky
*Attorney, Agent, or Firm*—Herbert Dubno; Andrew Wilford

[57] ABSTRACT

An internal combustion engine having intake and exhaust manifolds and a cylinder defining a combustion chamber in which a piston reciprocates and having a wall formed with a port has a combined poppet/slide valve. This valve has a lift valve having a head sealingly engageable in the port and movable in a predetermined direction between a raised position permitting flow past the head through the port and a closed position blocking flow through the port and a stem extending from the head in the direction and having an outer tappet end. It also has a sleeve centered on and rotatable about an axis generally perpendicular to the direction and formed with a radially contoured cam radially engaging the tappet end of the stem so that rotation of the sleeve about its axis displaces the valve between its positions. The sleeve is formed with a pair of axially offset and radially throughgoing apertures. A seat surface complementarily fitted to the sleeve is formed with a pair of axially offset apertures alignable with the apertures of the sleeve in respective angularly offset positions of the sleeve. The apertures of at least one of the pairs are angularly offset relative to each other with respect to the axis. A conduit extends between the port of the combustion chamber and the apertures of the seat surface. Structure inside the sleeve connects one of the apertures to the intake manifold and for connecting the other aperture to the exhaust manifold.

4 Claims, 1 Drawing Sheet

COMBINED SLEEVE/POPPET VALVE FOR INTERNAL COMBUSTION ENGINE

FIELD OF THE INVENTION

The present invention relates to a valve for an internal-combustion engine. More particularly this invention concerns a valve for controlling flow to and from a combustion chamber of such an engine.

BACKGROUND OF THE INVENTION

In a standard internal-combustion motor-vehicle engine flow into and out of the combustion chambers formed above the pistons is typically through respective intake and exhaust ports that are each closed during the compression and power strokes by a respective poppet or lift valves and respectively open during the intake and exhaust strokes. The intake ports are all connected to an intake manifold and the exhaust ports are all connected to an exhaust manifold. Each poppet valve is formed as a plug that is accurately machined to fit tightly in the respective port and that can be lifted, invariably by displacement into the chamber toward the pressurized side, to allow flow through the respective port. Such poppet valves are mounted on rods having tappet ends that ride on a camshaft that opens and closes them synchronously as needed by the type of engine.

The advantage of a lift or poppet valve is that it can withstand enormous pressure and extremes of heat. Thus it is ideal for use in a high-pressure hot spot in the wall of a cylinder of an internal-combustion engine. The disadvantage of such a valve is that it is fairly expensive to manufacture, due mainly to the high-quality heat-resistant metal it must be made of and the high accuracy with which it must fit in its seat. In addition two such valves must be provided for each cylinder, one to connect it to the exhaust manifold that carries away spent gases during the exhaust stroke and one to the intake manifold that supplies air during the intake stroke.

Hence attempts have been made to employ other valve types. U.S. Pat. Nos. 5,081,966, 5,154,395, 5,191,863, and 5,205,251 describe various systems employing a sleeve valve. Such a valve has a cylindrical sleeve formed with a port and rotated so that this port aligns with another port in a wall closely surrounding the sleeve. In such a valve the element moves parallel to its seat, as opposed to perpendicular to it like the poppet valve, and always moves in the same direction. Furthermore the sleeve can move continuously so that the wasted energy of a reciprocating movement of the valve body is avoided and certain other advantages are obtained. It is, however, very difficult to make such a valve sturdy enough to withstand long-term high-pressure use. Furthermore machining such a valve to form the very tight seal required for a combustion chamber of an internal combustion engine makes this alternative very costly.

OBJECTS OF THE INVENTION

It is therefore an object of the present invention to provide an improved valve system for an internal-combustion engine.

Another object is the provision of such an improved valve system for an internal-combustion engine which overcomes the above-given disadvantages, that is which is relatively simple and inexpensive, yet which can be counted on to have a long service life.

SUMMARY OF THE INVENTION

An internal combustion engine having intake and exhaust manifolds and a cylinder defining a combustion chamber in which a piston reciprocates and having a wall formed with a port has a combined poppet/slide valve. This valve has a lift valve having a head sealingly engageable in the port and movable in a predetermined direction between a raised position permitting flow past the head through the port and a closed position blocking flow through the port and a stem extending from the head in the direction and having an outer tappet end. It also has a sleeve centered on and rotatable about an axis generally perpendicular to the direction and formed with a radially contoured cam radially engaging the tappet end of the stem so that rotation of the sleeve about its axis displaces the valve between its positions. The sleeve is formed with a pair of axially offset and radially throughgoing apertures. A seat surface complementarily fitted to the sleeve is formed with a pair of axially offset apertures alignable with the apertures of the sleeve in respective angularly offset positions of the sleeve. The apertures of at least one of the pairs are angularly offset relative to each other with respect to the axis. A conduit extends between the single port of the combustion chamber and both apertures of the seat surface. Structure inside the sleeve connects one of the apertures to the intake manifold and the other aperture to the exhaust manifold.

Thus with this system a single rugged poppet valve is used for each cylinder, but the flow to and from the cylinder is directed by a more efficient sleeve valve. The advantages of both valve types are therefore exploited and the weaknesses are avoided. Furthermore since in a standard four-stroke engine the exhaust stroke directly precedes the intake stroke, the lift valve need merely open once per cycle, as the switchover between the exhaust and intake manifolds is done by the sleeve valve.

In accordance with this invention the apertures of the sleeve are angularly offset from each other. The flow-directing structure can be a crosswise partition in the sleeve between the apertures of the sleeve. In this case the exhaust manifold is connected to one end of the sleeve and the intake manifold to the other. So that a single sleeve can service a plurality of radial-engine combustion chambers, the structure can also be a tube inside the sleeve extending axially therein and connected to only one of the apertures of the sleeve. Thus the intake manifold is connected, for instance, to the inner tube and the exhaust manifold to the space between the inner and outer tubes.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
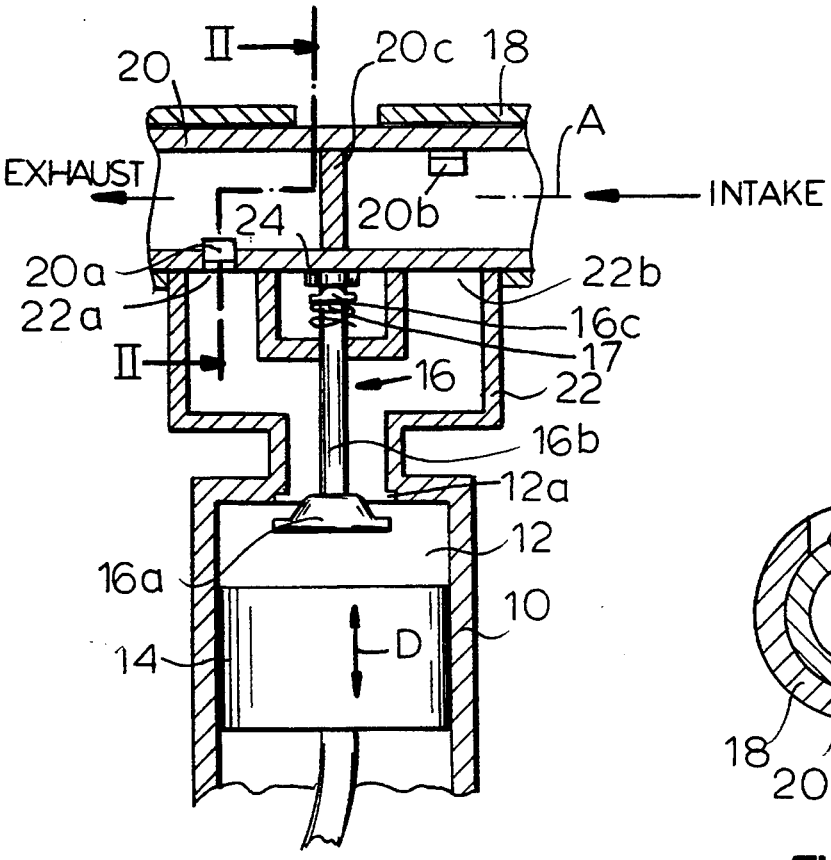
FIG. 1 is a largely schematic sectional view of the valve assembly of this invention.
Figure 2:
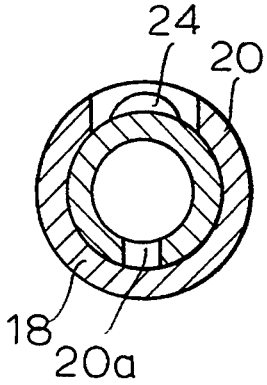
FIG. 2 is a cross section taken along line II—II of FIG. 1.

As seen in FIGS. i and 2 an internal-combustion engine has an engine block or housing 10 defining a combustion chamber 12 in which a piston 14 is reciprocal. The means for supplying fuel to the chamber 12 and igniting it are standard and are not shown in the drawing.

The wall of the chamber 12 is formed with a port 12*a* that can be blocked by a head 16*a* of a poppet valve 16 having a valve stem 16*b* terminating at its end opposite the head 16*a* in a cam-follower or tappet end 16*c*. A spring 17 surrounding the stem urges the valve 16 upward into the closed position. This tappet or lift valve 16 is of standard construction and moves in a direction D parallel to the direction D of reciprocation of the piston 14.

The engine housing 10 forms a cylindrical valve or seat surface 18 in which is fitted a cylindrically tubular valve sleeve 20 centered on an axis A perpendicular to the direction D. The housing 10 also forms a Y-shaped conduit 22 that opens at one end at the port 12*a* and at its opposite ends at two axially offset apertures 22*a* and 22*b* axially spaced along the seat surface 18 and sleeve 20.

The sleeve 20 is formed with a pair of axially spaced and radially throughgoing apertures 20*a* and 20*b* spaced apart axially the same as the apertures 22*a* and 22*b* and is internally provided with a transverse partition 20*c* between them. The apertures 20*a* and 20*b* are angularly offset to each other while the apertures 22*a* and 22*b* are axially aligned, although of course the opposite orientation would be possible. The interior of the sleeve 20 to one side of the partition 20*c* is connected to the engine's intake manifold and the opposite side is connected to the engine's exhaust manifold.

In addition the sleeve 20 is provided with a cam lobe 24 that can engage the tappet end 16*c* of the stem 16*b* to push the valve 16 against the force of the spring 17 into the open position. Thus for each full 360° rotation of the sleeve 20, the valve 16 will be opened once as the apertures 20*a* and 20*b* are aligned one after the other with the respective apertures 22*a* and 22*b*. More specifically, the sleeve 20 is rotated about its axis A, normally by connection to the unillustrated engine output shaft, to align first the aperture 20*a* with the aperture 22*a* and then the aperture 20*b* with the aperture 22*b*, and so on, with only one aperture aligned with the other at a time. The cam 24 is positioned such that as the one aperture 20*a* is aligned with the aperture 22*a*, the cam 24 is pushing the valve 16 down to open the port 12*a*, and when the other aperture 20*b* is aligned with the other aperture 22*b*, the cam 24 is still holding the valve 16 open.

Figure 3:
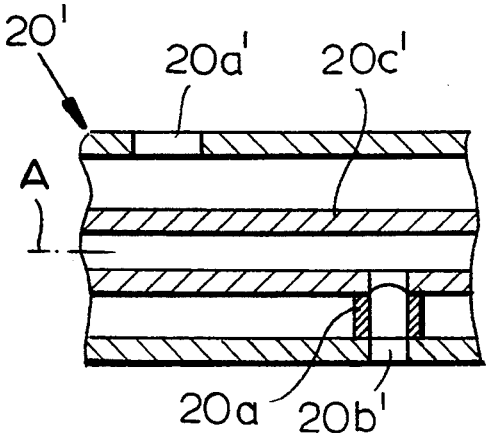
FIG. 3 is an axial section through an alternative valve sleeve according to the invention.

In the arrangement of FIG. 3 a sleeve 20' has no partition 20*c*. Instead it is internally provided with a coaxial inner tube 20*c'* connected via a tubular branch 20*d* to the aperture 20*b'*, while the other aperture 20*a'* opens into the space between the outer wall of the inner tube 20*c'* and the inner wall of the sleeve 20'. This arrangement is particularly useful for a system of chambers 12 aligned with one another as the sleeve 20' can have a number of pairs of apertures 20*a'* and 20*b'* equal to the number of chambers 12. In this way only one such sleeve 20' is needed to direct flow from all of the chambers.

Figure 4:
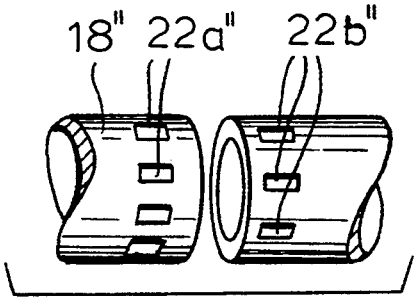
FIG. 4 is a small-scale largely diagrammatic view of another system according to this invention.

Similarly as seen in FIG. 4 in a radial-piston engine of the type described in U.S. Pat. Nos. 3,964,450, 3,931,810, and 4,334,506 where the heads of the cylinders are all directed radially inward toward a center axis it is possible to provide at this axis a sleeve-like seat 18'' with an annular row of the apertures 22*a''* and, axially offset therefrom, an annular row of the apertures 22*b''*. Each one of the apertures 22*a''* along with a respective one of the apertures 22*b''* is connected to a respective combustion chamber so that as the unillustrated two-port sleeve 20 rotates it connects the intake and exhaust manifolds sequentially to the apertures 22*a''* and 22*b''* one after the other. The sleeve 20 in such a system is provided as seen in FIG. 1 with one cam that sequentially opens and closes the poppets for all the combustion chambers. Thus a single two-aperture sleeve 20 can direct flow to and from a plurality of cylinders and control a plurality of tappets.

I claim:

1. In an internal combustion engine having intake and exhaust manifolds and a cylinder defining a combustion chamber in which a piston reciprocates and having a wall formed with a port, a valve assembly comprising:

a lift valve having a head sealingly engageable in the port and movable in a predetermined direction between a raised position permitting flow past the head through the port and a closed position blocking flow through the port and a stem extending from the head in the direction and having an outer tappet end;

a sleeve centered on and rotatable about an axis generally perpendicular to the direction and formed with a radially contoured cam radially engaging the tappet end of the stem, whereby rotation of the sleeve about its axis displaces the valve between its positions, the sleeve being formed with a pair of axially offset and radially throughgoing apertures;

a seat surface complementarily fitted to the sleeve and formed with a pair of axially offset apertures alignable with the apertures of the sleeve in respective angularly offset positions of the sleeve, the apertures of at least one of the pairs being angularly offset relative to each other with respect to the axis;

a conduit extending between the port of the combustion chamber and the apertures of the seat surface; and means including structure inside the sleeve for connecting one of the apertures to the intake manifold and for connecting the other aperture to the exhaust manifold.

2. The engine valve assembly defined in claim 1 wherein the apertures of the sleeve are angularly offset from each other.

3. The engine valve assembly defined in claim 1 wherein the structure is a crosswise partition in the sleeve between the apertures of the sleeve.

4. The engine valve assembly defined in claim 1 wherein the structure is a tube inside the sleeve extending axially therein and connected to only one of the apertures of the sleeve.

* * * * *